United States Patent [19]

Schmitt

[11] Patent Number: 4,901,818

[45] Date of Patent: Feb. 20, 1990

[54] FIRE FIGHTING ROOF LADDER ACCESSORY

[76] Inventor: Kevin P. Schmitt, 2403 Liberty Pl., Manitowoc, Wis. 54220

[21] Appl. No.: 297,517

[22] Filed: Jan. 17, 1989

[51] Int. Cl.[4] ..... E06C 5/32; E06C 7/08

[52] U.S. Cl. ..... 182/117; 182/228

[58] Field of Search ..... 182/117, 120, 121, 228

[56] References Cited

U.S. PATENT DOCUMENTS

| | | | |
|---|---|---|---|
| 1,008,827 | 11/1911 | Hutchinson | 182/117 |
| 1,487,243 | 3/1924 | Jackson . | |
| 1,886,921 | 11/1932 | Tobin . | |
| 2,308,832 | 1/1943 | Roney | 182/117 |
| 2,426,825 | 9/1947 | Geary . | |
| 2,439,185 | 4/1948 | Patt . | |
| 2,500,559 | 3/1950 | Miller | 182/121 |
| 2,856,112 | 10/1958 | Broderick . | |
| 2,948,349 | 8/1960 | Reddy . | |
| 3,848,700 | 11/1974 | Davis | 182/181 |
| 4,279,327 | 7/1981 | Warren . | |
| 4,531,613 | 7/1985 | Keigher . | |

*Primary Examiner*—Reinaldo P. Machado
*Attorney, Agent, or Firm*—Wheeler Law Firm

[57] ABSTRACT

A firefighting roof ladder accessory that is designed to be supported between two roof ladders. The accessory comprises a beam, having two foot supprot surfaces that are perpendicular to each other, and end boxes each extending over a ladder rail and provided at its outer edge with hooks that go over the rungs of the roof ladders.

2 Claims, 1 Drawing Sheet

FIRE FIGHTING ROOF LADDER ACCESSORY

BACKGROUND OF THE INVENTION

The device of this invention is a support to be placed on a roof between two ladders. Specifically, the invention is to be used in aiding firefighters cut holes in the roofs of burning buildings. In conventional firefighting procedure, where the roof of a building is exposed to the fire, it is necessary to open a hole in the roof so that the smoke and flame will be concentrated there rather than weakening the entire roof. This also creates an updraft that has a tendency to clear the windows and doors of smoke so that the firefighter may evacuate persons trapped in the building and may themselves enter the building to fight the fire.

In making such an opening usually a single roof ladder is hooked over the ridge of the roof. The firefighter must then lean over and chop a hole near the side of the ladder. This is a very awkward procedure. He may have to leave one foot on the ladder and put one foot on the roof. In that case, a burning roof weakened on the under side could collapse under the foot of the firefighter that is directly in contact with the roof thereby causing the firefighter to fall into the fire.

By use of a unique and simple design the invention may be used with two conventional ladders to form a safe support for the second foot of the fireman. The applicant's invention makes it exceedingly unlikely that the fireman would lack the support that is needed for him to maintain his balance when cutting a hole in a roof even if the fire underneath is severe.

While many devices are known which support either a step or a scaffold from one or more ladders, none are known to the inventor which use his method of hooking his invention to the ladders. For example U.S. Pat. No. 1,886,921 (Tobin) discloses a structure in which a pair of ladders support a board 33, see FIG. 6 of the Tobin patent, which crosses between them. The support structure shown at the right hand side of the illustration (FIG. 6) hooks over a single rung of the ladder. The structure shown at the left side of the illustration bolts to the side rail of the ladder. An alternative structure shown in FIG. 8 has a bracket around the side rail of the ladder. These structures are disclosed as alternatives to one another. However none of structures boxes the side rail and hooks over two of the rungs of the ladders, as does the applicant's invention. U.S. Pat. Nos. 4,279,327 (Warren) and 4,531,613 (Keigher) are two patents that relate specifically to firefighting but show a rather different structure than that of the applicant's invention in which a single ladder has an extension at the top wide enough to embrace the area where the hole is to be made. These two patents show devices that limit the firefighter to the area where the ladder has been hooked and as such are not nearly as adaptable as the applicant's invention. In addition the footing is not as secure.

The remaining prior art patents, specifically, U.S. Pat. No. 1,487,243 (Jackson), U.S. Pat. No. 2,426,825 (Geary), U.S. Pat. No. 2,439,185 (Patt), U.S. Pat. No. 2,856,112 (Broderick), and U.S. Pat. No. 2,948,349 (Reddy) show variations in which a step or a scaffold is supported from one or more ladders. Some of the prior art inventions attach to rungs of the ladder while others attach to the side rails but no case is there a single structure that both attaches to the rungs and boxes the side rails as does the applicant's invention. Also, the step or scaffold disclosed in the prior art is usually a board rather than a metal piece having non-skid tread elements.

SUMMARY OF THE INVENTION

The device of the present invention is an accessory or platform that is hung between two ladders and aids firefighters in cutting a hole in a roof by increasing the amount of support that they have and minimizing the potential danger should the roof weaken underneath them by giving the firefighter a platform which is stable and will not collapse under his weight as he works to ventilate the roof.

The center of the device has a sheet of non-skid metal parallel to the roof and a box section extending at a right angle to the roof so that at any pitch of the roof the foot of the fireman will have adequate support. At each end of the invention is a box which is deep enough to enclose the rail of the ladder regardless of the depth of the rail. The hooks at the lower edge of each outer side of a box have an opening that just tightly receives a ladder rung of standard size. The sheet material of which the hook is formed is narrow enough so that it will hook between the ladder rung and the roof regardless of the spacing of the ladder rung from the edge of the side beam of the ladder. Ladder side rails have several standard dimensions but because of the box this device will fit any of them.

A hand hole is provided to the center of the device to make it easier for a firefighter to carry to the point where it can be used.

An important distinction between the device of this invention and the prior art is that most of the prior art devices disclosed were designed to be used on ladders that are erected at the side of a building. The device of the instant invention is designed to be used when the ladders of a firefighter are hung over the peak or ridge of a roof in order for a firefighter to ventilate that roof. The invention is used with the two ladders that it is hooked to attached to the peak or upper edge of a roof.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

The firefighting roof ladder necessary as a whole is referred to as the unit 10 in this description. The unit 10 is comprised of side boxes 20 and a beam 30.

Figure 1:
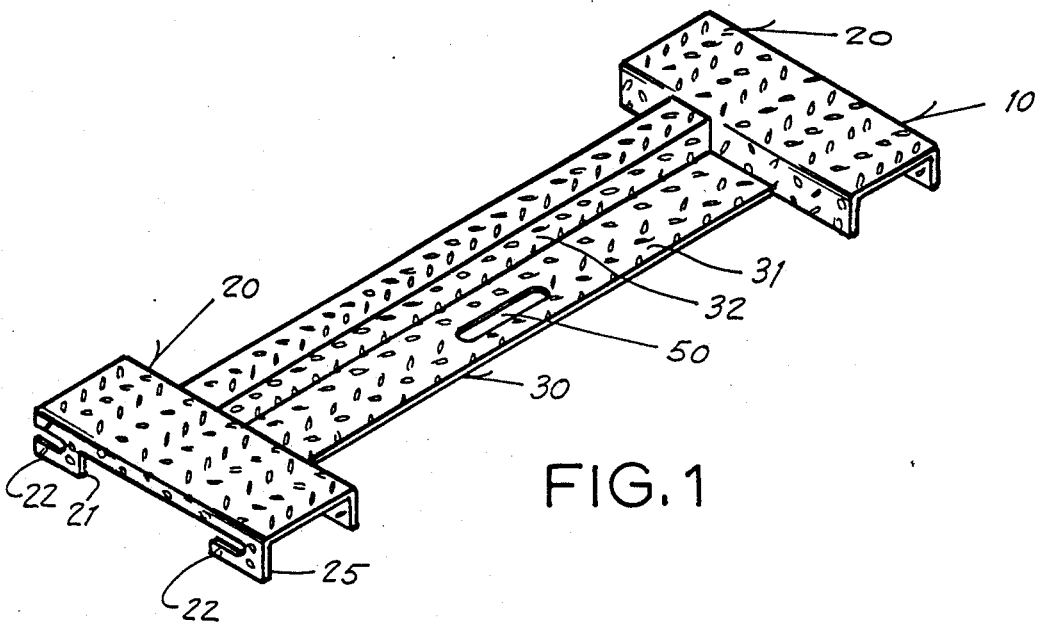
FIG. 1 is a perspective view of the firefighting roof ladder accessory.
Figure 2:
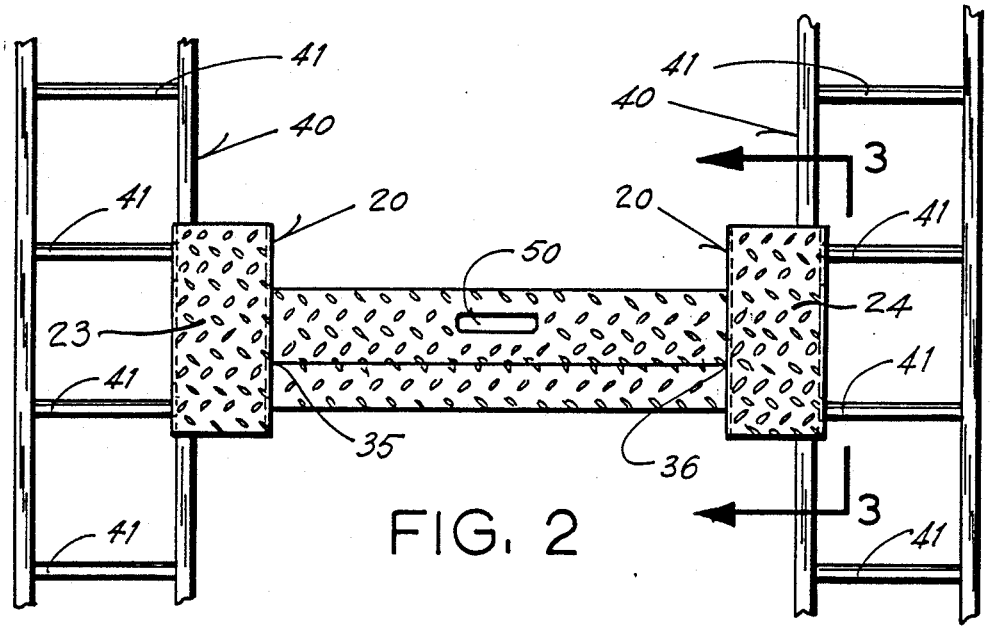
FIG. 2 is a top plan view showing the firefighting roof ladder accessory between two ladders as the invention would used by a firefighter.
Figure 3:
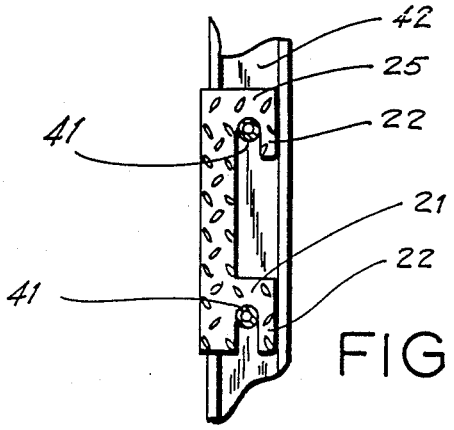
FIG. 3 is a cross sectional view on line 3—3 of FIG. 2.

As disclosed in FIGS. 1 and 3 each of the side boxes 20 have hooks 21 and 25 which allow the boxes 20 to be attached to the rungs 41 of the ladders 40; as illustrated in FIG. 2. The side boxes 20 of the unit 10 are of such width that they can be placed over a wide variety of ladders 40 despite those ladders having different sizes of ladder side rails 42. The hooks 21 and 25 of the side boxes 20 are open ended thereby allowing each hook 21 and 25 to attach to any rung 41. Each hook 21 and 25 has a end 22. Referring to FIG. 3 the position of end 22 in relationship to the ladder 40 and the ladder side rail 42 may be seen. The end 22 of the hooks 21 and 25 is designed to be sufficiently narrow so as to allow the hooks 21 and 25 to engage a wide variety of rungs 41 without engaging or coming into contact with the surface of the roof itself when the unit 10 is attached to the ladders 40 on the roof. The width of the end 22 is designed such that only the side rails 42 of each ladder 40 will be in contact with the roof when each ladder 40 is attached to the roof.

FIGS. 1 and 2 disclose a hand hole 50 located on the beam 30. The hole 50 allows a firefighter to easily carry the unit 10 up to the point where it can be used. The hole 50 is large enough to allow for a hand to pass through it but it is not large enough to allow the foot of a fireman standing on the beam 30 to pass through. This is especially true if the foot of the firefighter is in a boot as is usually the case when the firefighter is out working to extinguish a fire.

Still referring to FIGS. 1 and 2 the relationship of the beam 30 with the side boxes 20 and the ladders 40 may be seen. The beam 30 is comprised of two fire fighter support surfaces 31 and 32. When the unit 10 is attached to the ladders 40 that are hung from the peak or edge of the roof the surface 31 of the beam 30 is parallel to the surface of the roof while surface 32 of the beam 30 is perpendicular to the surface of the roof. This allows a firefighter to have a firm place of support upon which to brace himself when he is ventilating a roof no matter what the angle of that roof may be.

The unit 10 is made of metal. As such the beam 30 and the side boxes 20 are of a stiff rigid construction that will not bend or break under normal use; for example, when a fireman is standing on the beam 30. The structural strength of the unit 10 is increased by relationship of the side boxes 20 and the beam 30. The side boxes 20 are at right angles to the beam 30 and are longer than the width of the beam 30. This allows the side boxes 20 to cover a larger area and thereby increasing the stability as well as the stiffness of the beam 30 when the unit 10 is in use. This is because by having the side boxes 20 at right angles to the beam 30 the ability of the beam 30 to flex on bend under the weight of a firefighter is reduced. The ends 35 and 36 of the beam 30 are welded to the side boxes 20. Since the side boxes 20 are at right angles to the ends 35 and 36 the side boxes 20 are resistant to bending in the same direction as the ends 35 and 36. This resistance imparts greater stability and stiffness to the unit 10 as a whole thus making it a uniquely stable platform for a firefighter.

FIGS. 1 and 2 also show that the surfaces 31 and 32 of the beam and surfaces 23 and 24 of the side boxes are covered with gripping elements 33. The gripping elements 33 reduce the chance that a firefighter or other person who is using the beam 30 to support his or her foot could slip; thereby increasing their safety when using the unit 10.

For the purpose of the following claims a roof ladder is defined as a ladder having grappling means which allow the ladder to be easily hung from the ridge of a roof.

The above described embodiments of this invention are merely descriptive of its principles and are not to be limiting. The scope of this invention instead shall be determined from the scope of the following claims, including their equivalents.

What is claimed is:

1. A device to be supported between two roof ladders comprising:

a supporting beam having two ends;

a pair of run engaging fasteners secured to each said end;

said beam being capable of being supporting between said roof ladders by said pair of fasteners;

said beam having at least two flat angularly related foot support surfaces extending along said beam;

whereby a firefighter may place his foot on the beam to steady himself as he ventilates the roof of a burning building.

2. The device of claim 1 further comprising ladder rail enclosing means;

said angularly related surfaces joining at an angle of at least about 90°;

said ladder rail enclosing means being capable of enclosing a plurality of different sizes of side rails of said ladders;

whereby said device may be used on a wide variety of ladders.

* * * * *